US007140759B1

(12) United States Patent
Tsai et al.

(10) Patent No.: US 7,140,759 B1
(45) Date of Patent: Nov. 28, 2006

(54) LIGHT BEAM ADJUSTING DEVICE FOR VEHICLE

(75) Inventors: Chih-Ming Tsai, Taichung (TW); Jen Mao Wang, No. 15, Szwei Road, Nanyao Li, Changhua 500 (TW); Jihn-Shiun Lee, No. 1338, Sec. 2, Yonhu Road, Anpin Chu, Tainan 708 (TW)

(73) Assignees: Jen Mao Wang, Changhua (TW); Jihn-Shiun Lee, Changhua (TW)

( * ) Notice: Subject to any disclaimer, the term of this patent is extended or adjusted under 35 U.S.C. 154(b) by 0 days.

(21) Appl. No.: 11/047,846

(22) Filed: Feb. 1, 2005

(51) Int. Cl.
*F21V 11/00* (2006.01)

(52) U.S. Cl. ..... 362/539; 362/282; 362/324; 362/513

(58) Field of Classification Search ..... 362/282, 362/324, 512, 513, 539
See application file for complete search history.

(56) References Cited

U.S. PATENT DOCUMENTS 1,434,404 A * 11/1922 Nordstedt ..... 362/286
1,475,872 A * 11/1923 Piper ..... 362/285
1,871,551 A * 8/1932 O'Brien ..... 362/284
6,312,147 B1 * 11/2001 Eichler ..... 362/539
6,325,528 B1 * 12/2001 Wittmeier et al. ..... 362/514
6,874,923 B1 * 4/2005 Albou et al. ..... 362/512
6,997,590 B1 * 2/2006 Garcia et al. ..... 362/539

* cited by examiner

*Primary Examiner*—Stephen F Husar
(74) *Attorney, Agent, or Firm*—Charles E. Baxley

(57) ABSTRACT

A light beam adjusting device includes a housing having a reflector, a light device disposed within the reflector for generating light which may be partially reflected upwardly and partially reflected downwardly by the reflector. The light reflected downwardly by the reflector is allowed to emit out through the housing. A panel is disposed in the lower portion of the housing, and an actuating device may actuate the panel to selectively open and block the lower portion of the housing, and to selectively open and block the light reflected upwardly by the reflector. The light reflected upwardly by the reflector may form a high beam together with the light reflected downwardly by the reflector when the lower portion of the housing is not blocked by the panel.

7 Claims, 3 Drawing Sheets

LIGHT BEAM ADJUSTING DEVICE FOR VEHICLE

BACKGROUND OF THE INVENTION

1. Field of the Invention

The present invention relates to a vehicle headlight adjusting device, and more particularly to a vehicle headlight having a light beam adjusting device for adjusting the headlight to different light beams or to different light intensities.

2. Description of the Prior Art

Typical vehicle headlights comprise a light beam adjusting device to adjust the headlight to different light beams or to different light intensities, such as to high beam and low beam. For example, the typical vehicle light beam adjusting devices comprise a light bulb slidably received in a reflector, and movable relative to the reflector, in order to adjust to different light beams.

For example, U.S. Pat. No. 1,434,404 to Nordstedt discloses one of the typical vehicle headlights also including a light beam adjusting device having a light bulb slidably received in a reflector, and movable relative to the reflector by a solenoid core that is slidably received in solenoid coil, in order to adjust to different light beams. However, some of the light portion generated by the light bulb may also be reflected or emitted upwardly by the reflector.

U.S. Pat. No. 1,475,872 to Piper discloses another typical vehicle headlight including a light beam adjusting device having a light bulb slidably received in a reflector, and also movable relative to the reflector by a piano wire, in order to adjust to different light beams. However, similarly, some of the light portion generated by the light bulb may also be reflected or emitted upwardly by the reflector.

U.S. Pat. No. 1,871,551 to O'Brien discloses a further typical vehicle headlight including a light beam adjusting device having a light bulb slidably received in a reflector, and retractable to a position in rear of and entirely outside of the confines of the reflector, and at the same time disposing in front of the retracted lamp a screen of various natures or characters. However, similarly, some of the light portion generated by the light bulb may also be reflected or emitted upwardly by the reflector, and the light may be completely shielded when the lamp is retracted entirely outside of the confines of the reflector.

U.S. Pat. No. 6,325,528 to Wittmeier et al. discloses a still further typical vehicle headlight including a light beam adjusting device having a light bulb slidably received in a reflector and coupled to a light source base which is tiltable relative to the reflector by an electromagnetic solenoid, in order to adjust to different light beams. However, similarly, some of the light portion generated by the light bulb may also be reflected or emitted upwardly by the reflector.

The present invention has arisen to mitigate and/or obviate the afore-described disadvantages of the conventional vehicle light beam adjusting devices.

SUMMARY OF THE INVENTION

The primary objective of the present invention is to provide a vehicle light beam adjusting device for adjusting the headlight to different light beams or to different light intensities, and for preventing the light portion generated by the light bulb from being reflected or emitted upwardly by the reflector of the vehicle headlight.

In accordance with one aspect of the invention, there is provided a light beam adjusting device comprising a housing including a reflector, and including a lower portion, a light device disposed within the reflector, for generating light, and for allowing the light to be partially reflected upwardly and partially reflected downwardly by the reflector, the light reflected downwardly by the reflector being allowed to emit out through the housing, a panel provided in the lower portion of the housing, and an actuating device for actuating the panel to selectively open and block the lower portion of the housing, and to selectively open and block the light reflected upwardly by the reflector. The light reflected upwardly by the reflector may form a high beam together with the light reflected downwardly by the reflector when the lower portion of the housing is not blocked by the panel.

A frame may further be provided and attached to the lower portion of the housing, and includes a passage formed therein, for allowing the light reflected upwardly by the reflector to emit out through the passage of the frame, the panel being pivotally attached onto the frame, to selectively block the passage of the frame.

The frame includes at least one ear extended therefrom, the panel is pivotally attached to the ear of the frame with a pivot axle. The actuating means includes a solenoid device attached to the frame, and coupled to the panel, to selective rotate the panel to selectively open and block the passage of the frame.

The panel includes an arm extended therefrom and having a groove formed therein, the solenoid device includes a core slidably received in a coil and having a lever extended therefrom and slidably engaged through the groove of the arm, and at least one actuator attached to the lever and engageable with the arm, to selectively rotate the panel relative to the frame.

One or more spring members may further be provided and coupled between the frame and the panel, to bias the panel to selectively block the passage of the frame. The panel includes at least one bar extended therefrom and coupled to the frame with the spring member.

A partition may further be provided and attached to a front portion of the housing. A casing may further be provided and attached to the partition. The casing includes a lens disposed therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
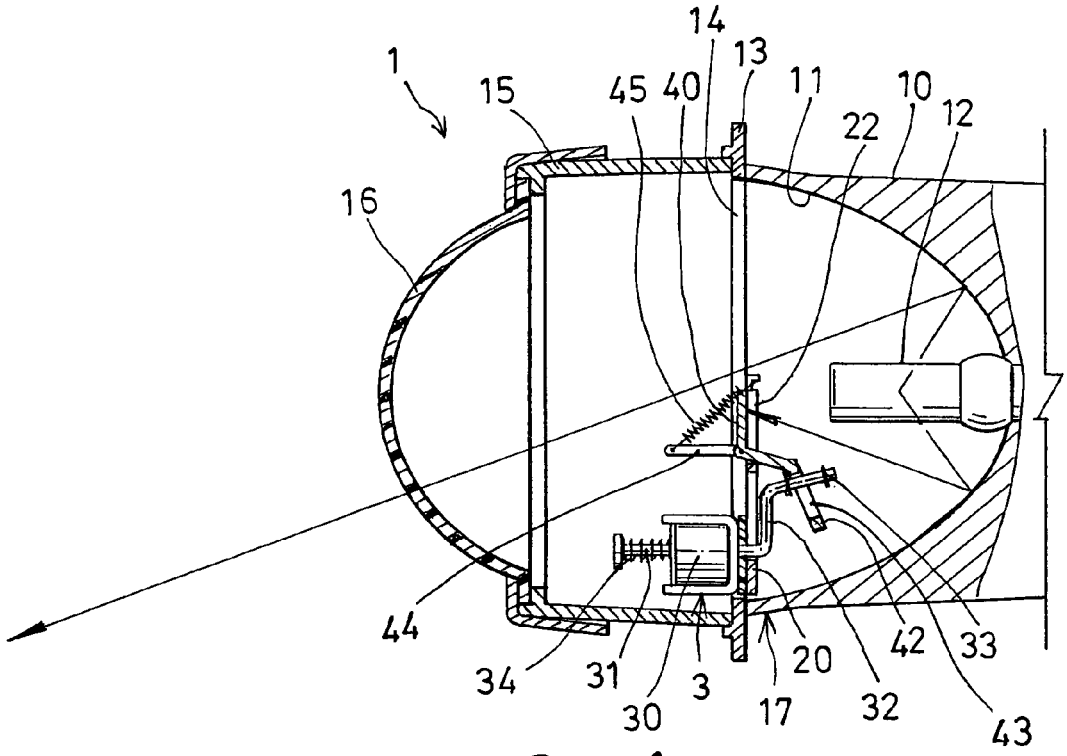
FIG. 1 is a partial cross sectional view of a vehicle light beam adjusting device in accordance with the present invention.
Figure 5:
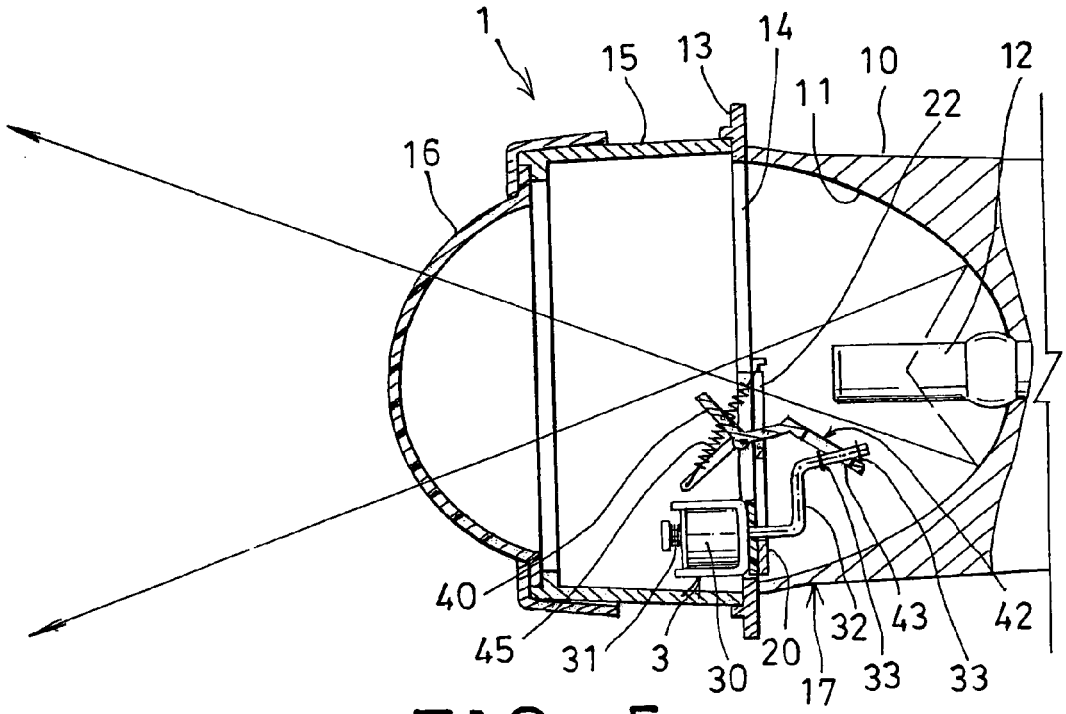
FIG. 5 is a partial cross sectional view similar to FIG. 1, illustrating the operation of the vehicle light beam adjusting device.
Figure 2:
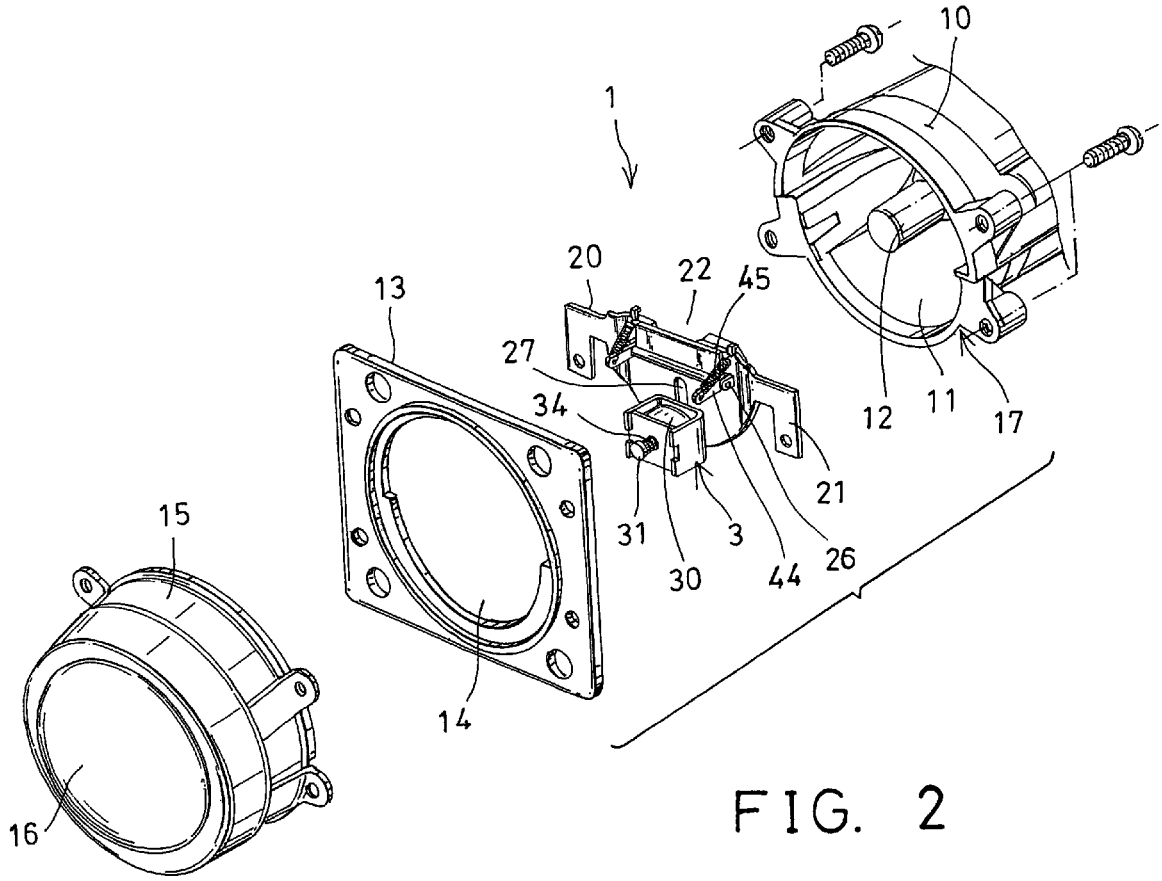
FIG. 2 is a partial exploded view of the vehicle light beam adjusting device.
Figure 3:
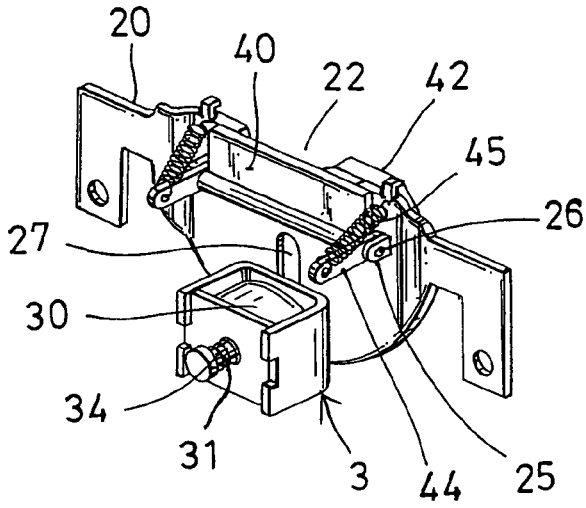
FIG. 3 is a partial perspective view of the vehicle light beam adjusting device.
Figure 4:
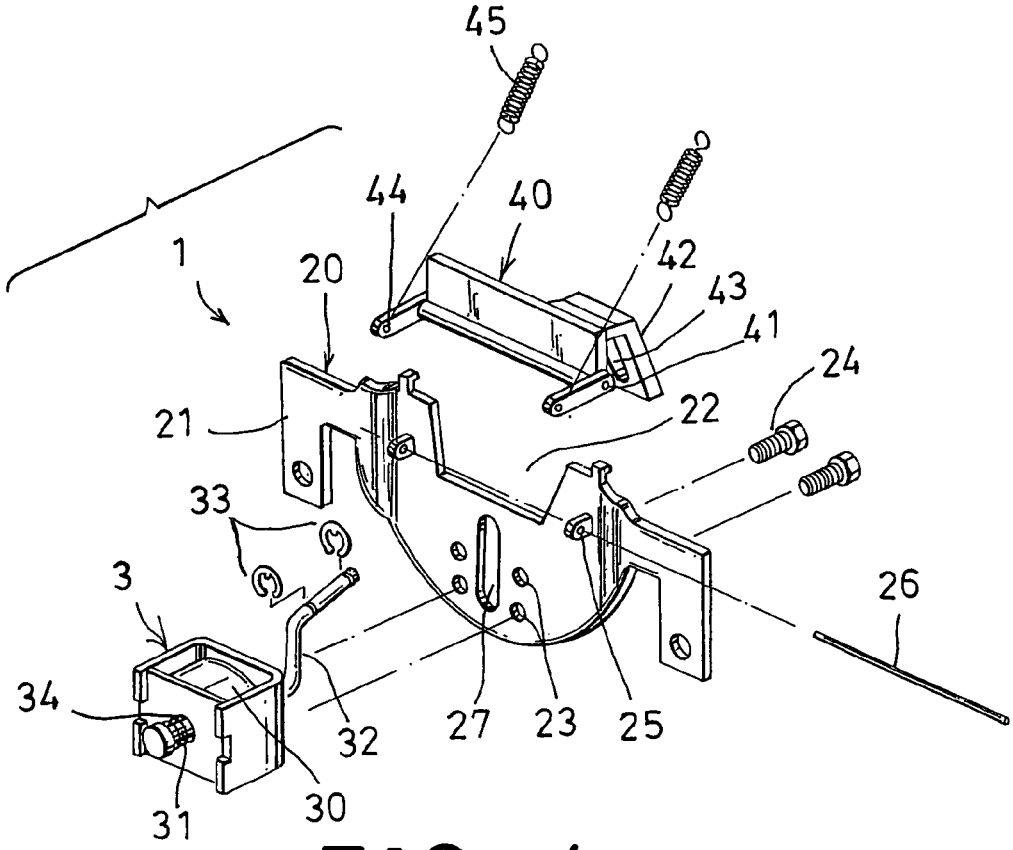
FIG. 4 is another partial exploded view illustrating elements of the vehicle light beam adjusting device as shown in FIG. 3.

Referring to the drawings, and initially to FIGS. 1–4, a vehicle headlight 1 in accordance with the present invention comprises a housing 10 including a reflector 11 disposed or provided therein, a light bulb or light device 12 disposed within the reflector 11, for generating light beams, and arranged for allowing the light beams to be reflected by the reflector 11 (FIGS. 1, 5).

A partition 13 may be attached to a front portion of the housing 10 with such as fasteners (not shown), and includes an opening 14 formed therein. A casing 15 may further be provided and secured to a front portion of the partition 13 or directly attached to the front portion of the housing 10 with such as fasteners (not shown), and a lens 16, such as a convex lens, or transparent lens 16 is attached to the front portion of the casing 15.

A frame 20 is secured to a lower portion 17 of the housing 10 or of the partition 13 with such as fasteners (not shown), and includes a passage 22 formed therein, and aligned with or located within the lower portion 17 of the housing 10, for allowing the light generated by the light device 12 to be emitted out through the passage 22 of the frame 20 (FIG. 5). The frame 20 includes one or more apertures 23 formed therein for receiving fasteners 24 which may be used to secure an actuating device or a solenoid device 3 to the frame 20.

The solenoid device 3 includes a coil 30, a core 31 slidably received in the coil 30 and movable or actuateable by the coil 30, and having a lever 32 extended from the core 31, and extended through a slot 27 of the frame 20. One or more, such as two retaining rings or actuators 33 are attached onto the lever 32. A spring member 34 may be engaged onto the core 31, for biasing or recovering the core 31 relative to the coil 30 of the solenoid device 3.

A panel 40 includes one or more orifices 41 formed therein, for receiving a pivot axle 26 which may be engaged through one or more ears 25 of the frame 20, to pivotally or rotatably attach or couple the panel 40 to the frame 20, and to allow the panel 40 to be rotated relative to the frame 20 to selectively shield or block the passage 22 of the frame 20 (FIG. 1), or to selectively open the passage 22 of the frame 20 (FIG. 5).

The panel 40 includes an arm 42 extended therefrom and having a groove 43 formed therein to slidably receive the lever 32 of the solenoid device 3. The actuators 33 of the lever 32 are arranged to engage with the arm 42, to rotate the panel 40 relative to the frame 20, and thus to cause the panel 40 to selectively shield or block the passage 22 or to selectively open the passage 22 of the frame 20 (FIGS. 1, 5).

The panel 40 further includes one or more bars 44 extended therefrom and coupled to the frame 20 with one or more spring members 45, which may bias or move the panel 40 relative to the frame 20, to such as open or block or shield the passage 22 of the frame 20. The solenoid device 3 may rotate the panel 40 relative to the frame 20 to cause the panel 40 to selectively shield or block the passage 22 or to selectively open the passage 22 of the frame 20 against the spring members 45, for example.

As shown in FIGS. 1 and 5, the light generated by the light device 12 may be selectively emitted out through the opening 14 of the partition 13. The upper portion of the opening 14 of the partition 13 has not been blocked or shielded such that the light reflected downwardly by the reflector 11 will not be blocked or shielded, and may emit freely out of the casing 15 and the lens 16.

The other portion of the light generated by the light device 12 and reflected upwardly by the reflector 11 may be selectively emitted out through the passage 22 of the frame 20 (FIG. 5), but may be selectively blocked or shielded by the panel 40 (FIG. 1) when the panel 40 is rotated relative to the frame 20 to block the passage 22 of the frame 20.

In operation, as shown in FIG. 1, when the actuating device or solenoid device 3 has not be actuated or energized or operated, the spring members 45 may bias or move the panel 40 toward the frame 20 to block the passage 22 of the frame 20, and thus to block and to prevent the other portion of the light generated by the light device 12 and reflected upwardly by the reflector 11 from being emitted or transmitted out through the passage 22 of the frame 20.

At this moment, only a portion of the light generated by the light device 12 may be reflected and emitted downwardly by the reflector 11, and may be emitted or transmitted out through the opening 14 of the partition 13 to form a low beam. The light generated by the light device 12 and reflected upwardly by the reflector 11 will not be emitted or transmitted out through the opening 14 of the partition 13 at this moment.

On the contrary, as shown in FIG. 5, the panel 40 may be rotated relative to the frame 20, by the actuators 33 of the lever 32 or of the core 31, to selectively open the passage 22 of the frame 20, and thus to allow the other portion of the light generated by the light device 12 and reflected upwardly by the reflector 11 to be selectively emitted out through the passage 22 of the frame 20.

At this moment, and simultaneously, the light generated by the light device 12 and reflected downwardly by the reflector 11 may also be emitted or transmitted out through the opening 14 of the partition 13 to form a high beam or to form a high intensity light beam together with the light reflected and emitted upwardly by the reflector 11.

The spring biasing devices or spring members 45 and the actuating device 3 may thus be formed as an actuating means or device for selectively causing or moving the panel 40 to open or block the lower portion 17 of the housing 10, and thus for allowing the light reflected upwardly by the reflector 11 to be selectively blocked by the panel 40 and by the actuating means or device formed or defined by the spring biasing devices or spring members 45 and the actuating device 3.

It is to be noted that the panel 40 may be directly and pivotally attached to the lower portion 17 of the housing 10, without the frame 20, to selectively open or block the lower portion 17 of the housing 10, and thus to allow the light generated by the light device 12 and reflected upwardly by the reflector 11 to be selectively opened or blocked by the panel 40.

Accordingly, the vehicle headlight in accordance with the present invention includes a light beam adjusting device for adjusting the headlight to different light beams or to different light intensities, and for preventing the light portion generated by the light bulb from being reflected or emitted upwardly by the reflector of the vehicle headlight.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A light beam adjusting device comprising:

a housing including a reflector, and including a lower portion, a light device disposed within said reflector, for generating light, and for allowing the light to be partially reflected upwardly and partially reflected downwardly by said reflector, the light reflected downwardly by said reflector being allowed to emit out through said housing, a panel provided in said lower portion of said housing, and said panel including an arm extended therefrom and having a groove formed therein, an actuating means for actuating said panel to selectively open and block said lower portion of said housing, and to selectively open and block the light reflected upwardly by said reflector, the light reflected upwardly by said reflector forming a high beam together with the light reflected downwardly by said reflector when said lower portion of said housing is not blocked by said panel, and a frame attached to said lower portion of said housing, and including a passage formed therein, for allowing the light reflected upwardly by said reflector to emit out through said passage of said frame, said panel being pivotally attached onto said frame, to selectively block said passage of said frame, said actuating means including a solenoid device attached to said frame and coupled to said panel to selective rotate said panel to selectively open and block said passage of said frame, said solenoid device including a core slidably received in a coil and having a lever extended therefrom and slidably engaged through said groove of said arm, and at least one actuator attached to said lever and engageable with said arm, to selectively rotate said panel relative to said frame.

2. The vehicle light beam adjusting device as claimed in claim; 1, wherein said frame includes at least one ear extended therefrom, said panel is pivotally attached to said at least one ear of said frame with a pivot axle.

3. The vehicle light beam adjusting device as claimed in claim 1 further comprising at least one spring member coupled between said frame and said panel, to bias said panel to selectively block said passage of said frame.

4. The vehicle light beam adjusting device as claimed in claim 1 further comprising a partition attached to a front portion of said housing.

5. The vehicle light beam adjusting device as claimed in claim 4 further comprising a casing attached to said partition.

6. The vehicle light beam adjusting device as claimed in claim 5, wherein said casing includes a lens disposed therein.

7. A light beam adjusting device comprising:

a housing including a reflector, and including a lower portion, a light device disposed within said reflector, for generating light, and for allowing the light to be partially reflected upwardly and partially reflected downwardly by said reflector, the light reflected downwardly by said reflector being allowed to emit out through said housing, a panel provided in said lower portion of said housing, an actuating means for actuating said panel to selectively open and block said lower portion of said housing, and to selectively open and block the light reflected upwardly by said reflectors the light reflected upwardly by said reflector forming a high beam together with the light reflected downwardly by said reflector when said lower portion of said housing is not blocked by said panel, a frame attached to said lower portion of said housing, and including a passage formed therein, for allowing the light reflected upwardly by said reflector to emit out through said passage of said frame, said panel being pivotally attached onto said frame, to selectively block said passage of said frame, and at least one spring member coupled between said frame and said panel, to bias said panel to selectively block said passage of said frame, and said panel including at least one bar extended therefrom and coupled to said frame with said at least one spring member.

* * * * *